US005281107A

United States Patent [19]

De Koning

[11] Patent Number: 5,281,107

[45] Date of Patent: Jan. 25, 1994

[54] CONTROL SYSTEM FOR PISTON MEMBRANE PUMP

[75] Inventor: Cornelis J. De Koning, ED Velden, Netherlands

[73] Assignee: Baker Hughes Incorporated, Houston, Tex.

[21] Appl. No.: 944,675

[22] Filed: Sep. 15, 1992

[30] Foreign Application Priority Data

Sep. 16, 1991 [NL] Netherlands ..... 9101556

[51] Int. Cl.[5] ..... F04B 9/08

[52] U.S. Cl. ..... 417/386

[58] Field of Search ..... 417/385, 386, 387, 388

[56] References Cited

U.S. PATENT DOCUMENTS 4,966,528 10/1990 Henkel ..... 417/386

*Primary Examiner*—Richard E. Gluck

[57] ABSTRACT

A control system for a piston membrane pump having a pressure chamber is mounted on one side of the membrane, into which chamber a controllable loading and unloading device communicates, computing means connected to the loading and unloading device. Calculations occur in the computer that, dependent on, for example, the actual position of the membrane, the velocity of the membrane, the acceleration thereof, the pressure in the pressure chamber, the beat-frequency of the pump, etc., to determine the length of time for respective delay periods occurring before loading and unloading periods, during which periods hydraulic medium is brought into or allowed out of the pressure chamber by the loading and unloading device.

10 Claims, 2 Drawing Sheets

CONTROL SYSTEM FOR PISTON MEMBRANE PUMP

BACKGROUND OF INVENTION

1. Field of the Invention

The invention pertains to a system for controlling a piston membrane pump embodied with at least one membrane, whereby the membrane can be moved in a controlled manner as detected by means of indicators and with a desired beat-frequency between two end positions in a pressure chamber to be loaded with hydraulic medium during suction and compression periods (for example, see periods S and P in FIGS. 2 and 3), and whereby the system is provided with computer means, such as a microprocessor connected to the indicators, for the purpose of providing the computer means with position-indication signals, and a loading and unloading device connected to the computer means and the pressure chamber, for the purpose of adding and removing hydraulic medium during respective loading and unloading periods (for example, see periods c and d in FIGS. 2 and 3).

2. State of the Art

A prior art system is shown in U.S. Pat. No. 4,966,528, for use in pumping aggressive or abrasive media. The piston membrane pump included in the known system possesses an elastically moveable membrane which separates moving parts of the pump from the medium to be pumped. The pumping motion of the membrane is brought about by using moving parts such as a piston, piston arm, etc., to periodically remove and add hydraulic medium from and to the pressure chamber during respective suction and compression periods. Electrical indicators, embodied as displacement detectors, are mounted on an arm fixed to the membrane, and these furnish a signal which is used as a basis for detecting the end positions in a range of movement of the membrane. The end positions, between which the membrane should move if the possibility of fracture is to be as small as possible, delimit the suction and compression periods occurring during the movement of membrane between end positions. Since leakage of the hydraulic medium between the cited moving parts of the pump cannot be avoided at the high pressures in the medium required to move the membrane to its end position, the hydraulic medium in the pressure chamber is constantly replenished and pumped off by means of a loading and unloading device under command from the position-indication signals furnished by the indicators. The purpose of this is to keep the pump-yield constant despite the different working pressures and varying viscosity of the sludge to be pumped. Loading of the pressure chamber with hydraulic medium from a reservoir occurs via a controllable filling valve in the loading and unloading device, and happens in the suction period i.e. while there is a relatively low pressure in the pressure chamber; on the other hand, unloading occurs during the pressure period, during an unloading phase which coincides with the pressure period, when there is a high pressure in the pressure chamber.

The known system functions under normal operating conditions with a suction pressure between approximately 1 and 4 bar (atmospheres of pressure), a compression pressure below approximately 120 bar, and an appropriate nominal beat-frequency of the membrane. However, if application occurs under circumstances which deviate substantially from the normal operating conditions, e.g. pumping a medium with a high yield at suction pressures substantially higher than 4 bar or compression pressures higher than 120 bar, the known system appears to be poorly capable of adjusting to the operating conditions concerned and functioning optimally in the working field.

The purpose of the invention is to provide a system for controlling a piston membrane pump, which system has a broader working field and yet functions in an accurate manner, especially when full capacity is attained.

To this end, the system according to the invention is characterized in that it includes computing means having inputs connected to the indicators, and in that the computing means is arranged to use the position-indication signals to calculate the duration of delay periods (as shown for example at e, f in FIG. 3) beginning around those times when the membrane is at its end positions, the calculation occurring on the basis of the chosen length of the respective separate unloading and loading periods (c, d) immediately following the delay periods (e, f).

The advantage of the system according to the invention is that the starting-times of the loading and unloading periods, which coincide with the cessation of the respective delay periods, can be freely chosen, along with the duration of the unloading and loading periods. If so desired, the choice can be made to depend on the specific operating conditions. Above all, the corresponding calculations of the starting-times and durations of the respective delay periods occur in an accurate manner in the computer means. In this manner, the possibility that too much or too little hydraulic medium will be injected into or removed from the pressure chamber during respective loading and unloading periods is substantially reduced, whereby possible overloading of the membrane, particularly at lower beat-frequencies and higher working pressures, is practically excluded, the lifetime of the system is correspondingly increased and wear in the system is reduced. As a result of the high accuracy in controlling the operation of the pump, the regulating system will enable stable and gentle regulation, without the system being subjected to continual filling, unloading, filling, etc.

SUMMARY OF THE INVENTION

One embodiment of the system according to the invention is characterized in that the computer means is arranged such that the loading and unloading device will only load or unload the pressure chamber if one of the indicators establishes that the membrane has moved beyond a predetermined end position.

In this embodiment, the electrical indicators can, if so desired, be embodied as magnetic or induction switches. In practice, a permanent magnet might be fixed to a non-magnetic material on a support carried on the membrane, with the position of the magnet being detected using magnetic switches.

A following embodiment of the system according to the invention is characterized in that the computer means is arranged so as to determine the time of the approach of the membrane toward consecutive end positions, and to employ these times as the starting-times of the respective delay periods. This determination is made on the basis of the magnitude of the variation of the position-indication signals per unit time.

In this manner, the system according to the invention offers the possibility of incorporating the velocity of the membrane into the control of the system, by simple differentiation of the position-indication signals with respect to time. In such a case, the electrical indicators will be arranged to provide continuous position-indication signals.

If so desired, the acceleration which the membrane undergoes under various circumstances can also be introduced as a variable into the control system, via a further differentiation of the velocity with respect to time.

In another embodiment of the system according to the invention, the computer means is provided with an input, to which is connected a sensor for measurement of the beat-frequency of the membrane.

Especially when starting up the system, the variable in the form of the beat-frequency is important in limiting the rate of increase in the number of beats per unit time, and preventing the occurrence of excessive loads in the system during start-up. More importantly, given the known instantaneous increase in the beat-frequency during start-up, and given the time at which an end position is attained, an estimate can be made of the time at which the other end position will be attained, thereby preventing commencement or cessation of the loading and unloading periods at times when loading or unloading of the pressure chamber is undesirable or even impossible, especially during the start-up phase when the delay periods (e, f) are required to keep pace with the increasing beat-frequency.

In a further embodiment of the system according to the invention, the pressure is introduced as an additional variable into the system according to the invention, which is thence characterized in that it includes a pressure sensor mounted in the pressure chamber and in that the computer means possesses an input connected to the pressure sensor.

A preferred embodiment of the system according to the invention is characterized in that the delay periods (e, f) have such durations that the respective loading and unloading periods (d, c) terminate at times which lie within the suction period (S).

The advantage associated herewith is that, in so doing, one is not restricted to a loading and unloading device which closes during the periods of high pressure in the compression period, and which device must be of expensive construction.

A further refinement and adjustment to the specific operating conditions results in a preferential embodiment of the system according to the invention which is characterized in that the computer means is provided with an input to which a sensor for measuring the beat-frequency of the membrane is connected, and whereby, in a further preferential embodiment, the computer means is thus arranged that it uses the beat-frequency as a basis for distinguishing between a primary program run; in which the loading period begins before the transition from a suction stage to a compression stage, and ends after that transition, and in which the unloading period begins before the transition from the compression stage to the suction stage, and ends thereafter; and a secondary program run, in which lie the respective calculated delay periods, before the distinct electable loading and unloading periods.

Under practical operating conditions of the system, hysteresis dependent upon the value of the beat-frequency may be induced. A further preferential embodiment of the system according to the invention is characterized in that the computer means is arranged that, so that if a preliminarily value of the beat-frequency is exceeded, the secondary program run will be initiated at the expense of the primary program. Only in the event that the value of a secondary beat-frequency is reached, which value is smaller than the value of the primary beat-frequency, the primary program run will be initiated at the expense of the secondary program run (see FIG. 4).

In this way, one ensures that, during cyclical pump torque fluctuations, any variations which occur in the motor speed and the beat-frequency will not lead to continuous interchange of the respective program runs.

In a following preferential embodiment, the system according to the invention is characterized in that the system possesses a memory bank with writing and reading capability, whereby the variation in the values of quantities which are relevant to the current pumping process can be written and stored using the means for writing in memory, and whereby a desired selection of the value-variations, to be used in diagnosis and analysis of the process, can be read out of memory using the reading means and made intelligible in a desired manner.

BRIEF DESCRIPTION OF THE DRAWINGS

The invention and its further advantages will be elucidated using the drawing following hereafter. In this drawing.

DESCRIPTION OF THE PREFERRED EMBODIMENTS

Figure 1:
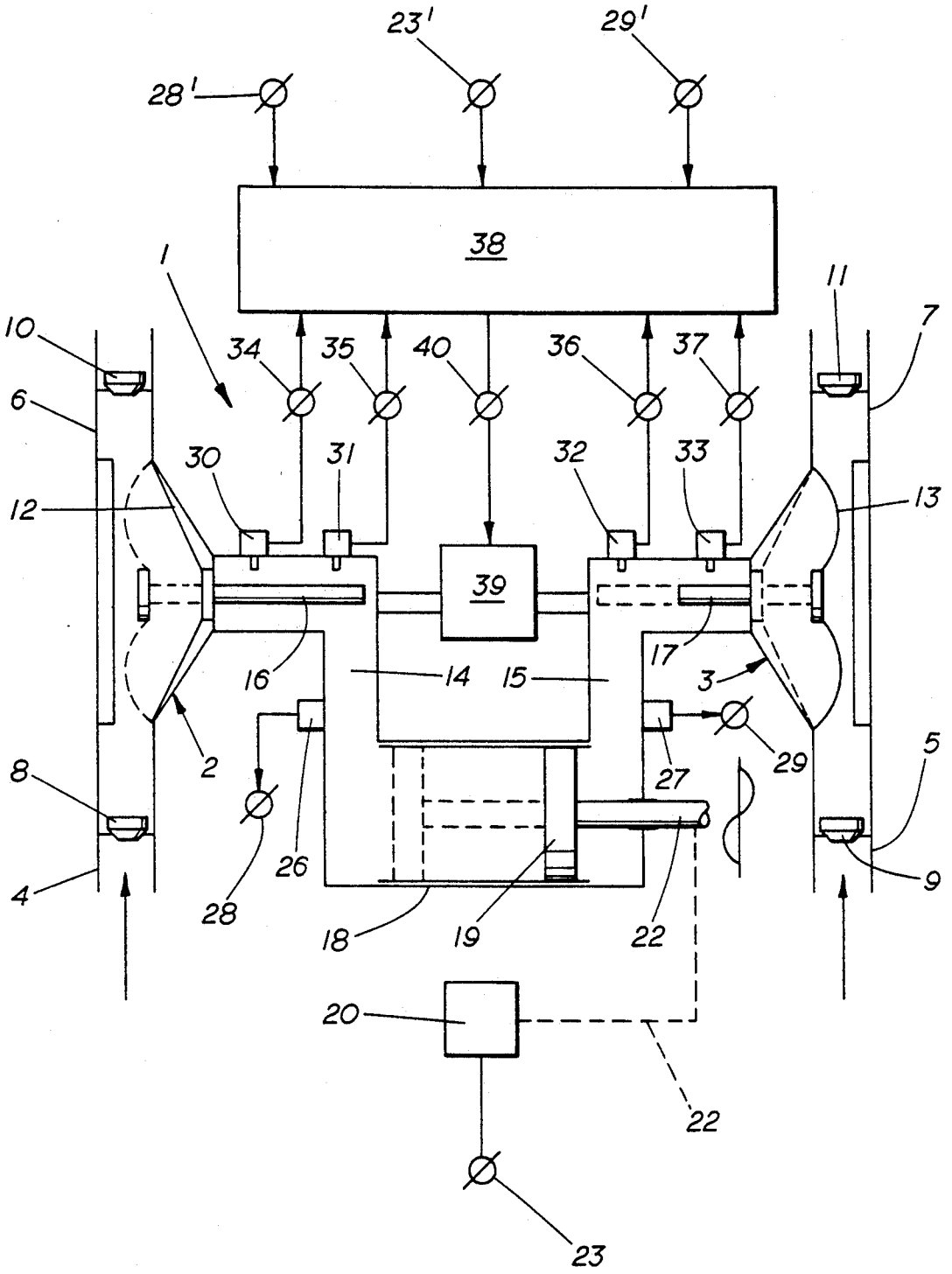
FIG. 1 depicts a preferential embodiment of the control system according to the invention.

FIG. 1 shows an embodiment of a system 1 which is partially depicted as a preferential embodiment, whereby it includes a double piston membrane pump 2, 3, whereby the respective pumps 2, 3 are fitted in supply pipes 4, 5 and removal pipes 6, 7. Suction valves 8, 9 are located in each of the supply pipes 4, 5, through which sludge moves in the direction of the arrow, and compression valves 10, 11 are located in the removal pipes 6 and 7.

The piston membrane pumps 2 and 3 are each provided with elastically moveable membranes 12 and 13, to which regulating rods 16 and 17 are attached, which rods can be moved in the longitudinal direction in the respective pressure chambers 14 and 15. In the pressure chambers 14, 15 is located a hydraulic medium which is moved back and forth by a piston 19 which can be moved in cylinder 18, whereby the membranes 12 and 13 move back and forth and the sludge is extruded from the supply pipes 4 and 5 during a suction period and is pressed towards the removal pipes 6 and 7 during a compression period. The extents of the various periods are hereby dependent on the beat-frequency of the piston 19. The piston 19 is coupled to a motor 20 via a mechanism which is not depicted in FIG. 1 but which often includes a crank handle. The angular velocity of the motor 20 can be regulated, if so desired, using means which are not depicted. Via the motor 20, a piston rod 22, connected to the piston 19, is moved back and forth with a certain beat-frequency. The motor 20, which is provided with an angular velocity sensor (in the form of a tachometer, for example) , possesses an output 23 at which can be received a signal which is a measure of the angular velocity of the motor. If so desired, a beat-frequency sensor, which is not depicted, can be coupled to the piston rod 22, which sensor services to furnish a signal which is a measure of the beat-frequency of the piston rod 22. The beat-frequency can also be derived from signals furnished at the outputs 28 and 29 by corresponding pressure sensors 26 and 27. The pressure sensors 26 and 27 are mounted in the pressure chambers 14 and 15. Also mounted in the pressure chambers 14 and 15 are indicators 30, 31, 32 and 33 which register, for example, overshoot or approach of the end positions of the regulating rods 16 and 17 and the membranes 12 and 13 attached thereto. The indicators 30–33 may, for example, be of electrical, magnetic or inductive nature, so as to function as approach sensors, but may also be of opto-electronic or Doppler-electronic nature, if so desired, in which case a signal, which is a measure of the momentary positions of the membranes 12 and 13, is continuously furnished. The corresponding electrical signals furnished by the indicators 30–33 are passed via connections to inputs 34, 35, 36 and 37 of means for computing 38, such as a microprocessor or other suitable electronic calculating and processing unit, mounted within the system 1. Moreover, the computer means 38 possesses three inputs 23', 28' and 29' which are connected to the respective indicator outputs 23, 28 and 29.

Furthermore, the system 1 includes a loading and unloading device 39, schematically depicted in FIG. 1 as being connected to the pressure chambers 14 and 15, which is provided with the necessary valves, which valves can be influenced by a control input system 40 connected to the computer means 38.

The indicators 30–33 furnish the computer means 38 with position-indication signals which, depending on the type of indicator chosen, are either furnished continuously, throughout the motion of the regulating rods 16 and 17, or are only furnished when the end positions of the membrane are being approached or have been overshot.

Figure 2:
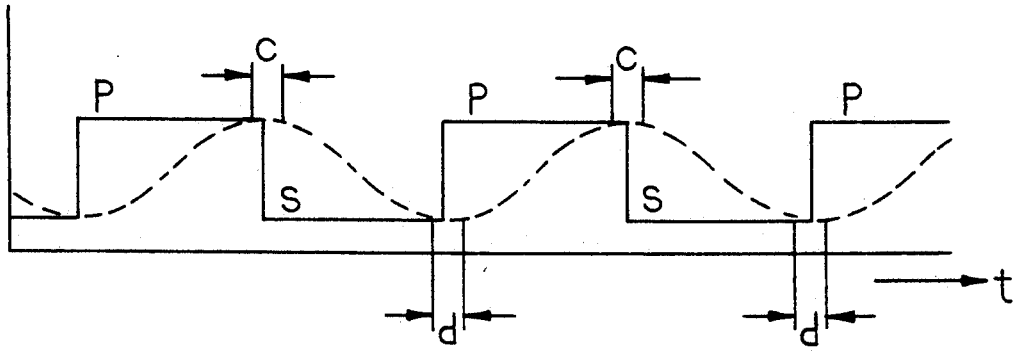
FIGS. 2 and 3 show timing diagrams in the respective instances of lower beat-frequency or so-called primary mode of operation and higher beat-frequency or so-called secondary mode of operation, according to which the operation of the system according to FIG. 1 will be further elucidated.
Figure 3:
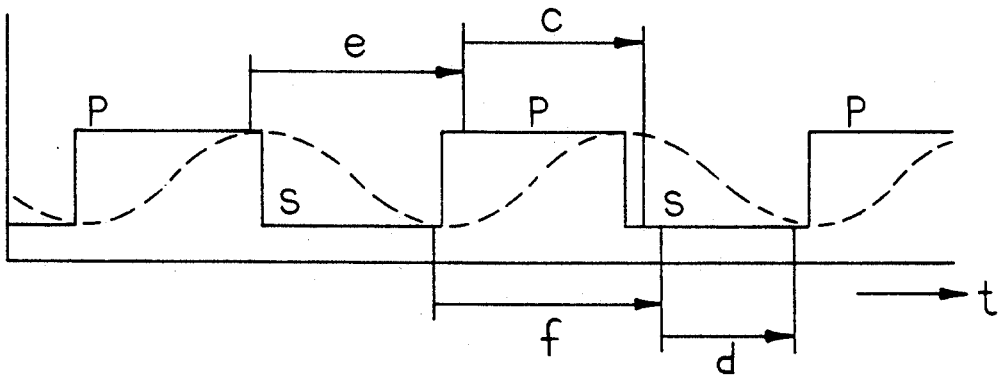

So as to illustrate the operation of the system 1, the mutually successive suction periods (S) and compression periods (P) are depicted in FIGS. 2 and 3 in time sequence. The actual position of the membrane 12, 13 concerned is depicted via a wavy broken line.

The control of the loading and unloading device 39 by the computer means 38 is determined by the program executed by the computer 38. The program in the computer 38 is such that, after it has been established, on the basis of the indicators 30 or 33, that a respective membrane 12 or 13 is approaching or overshooting an end position, which happens around the end of the pressure phase (P), a primary delay period e is calculated in a manner whereby the unloading period c immediately following this delay period has a duration which may be chosen. In just the same manner, approach or overshoot of the other end position by the respective membrane 12 or 13 precipitates calculation of a secondary delay period f, in which provision is made for the length of the chosen loading period d immediately following the period f. The loading period d and the unloading period c preferably end within the suction period S shown in FIG. 3. In the computer 38, approach of the end positions can be derived directly on the basis of the position-indication signals furnished by the indicators concerned, but can also be established on the basis of the derivative of the position-indication signals with respect to time i.e. the velocity. In approaching the end positions, the velocity shall steadily decrease, which decrease can be registered in the computer means 38 via a simple process of comparison, or analysis of overshoot-/underscore. More importantly, the velocity of the membranes is of possible importance in the event that an analysis/diagnosis of the functioning of the system as a whole is desired. Via further differentiation of the velocity with respect to time, the acceleration becomes available as an additional diagnostic variable.

For a given duration of the periods c and d, and for a given number of piston-beats per minute, the calculation of the primary delay period e occurs on the basis of the formula:

$$e=(60/n)-c$$

where e and c can be expressed in seconds. If, as an example, it is desired that the periods f and d, which can be expressed in seconds, cumulatively account for 330 degrees of the full beat-period of 360 degrees, then the computer means 38 calculates the delay period f according to the formula:

$$f=(60/n)\ (330/360)-d$$

The program run to be programmed into the computer means 38 can result in the calculations given above for the different periods c, d, e and f. The program run given above, however, should preferably be combinable with a program run in which the calculations occur in a manner which will further be elucidated with respect to FIG. 2.

In the time sequence diagram of FIG. 2, the delay periods e and f are equal to zero. The unloading period c and the loading period d form periodic intervals within which lie the respective transitions from pressure phase to suction phase and from suction phase to pressure phase. In applying induction or magnetic switches, for example, the duration of the periods c and d corresponds to the activation time of the indicators. Execution of either program can, for example, be made to depend on the value of the beat-frequency, so that, in the start-up phase in particular, the membrane in particular is not subjected to extreme loading forces which could result in a shortening of working life. Naturally, other variables can also be introduced into the various program runs, such as the velocity or acceleration of the membrane, the pressure or pressure-variations in the pressure chambers 14 and 15, the angular velocity of the motor, etc. The values of these variables can also, of course, be used in assigning desired durations to the periods c, d, e and f . In this way, the system can be flexibly adapted to suit the manner of operation. The available measured variables in the system furnish a great quantity of information, which can be processed by the computer means and, if necessary, be rendered visible on a display device, offering extensive possibilities for acquiring and deepening insight into the behavior of the system under various circumstances. For the purpose of error analysis, diagnostic signals can be defined using combinations of the available variables, thus assisting detection and prevention of an undesired combination of factors.

It is preferable to provide the system with memory having read and write capabilities, in which the evolution in the values of the relevant process variable is stored, thus allowing the history to be included in any considerations involved in making a diagnosis or an analysis of the system. This aid is particularly useful in setting up an error analysis, in which case the data stored in memory are called up.

Figure 4:
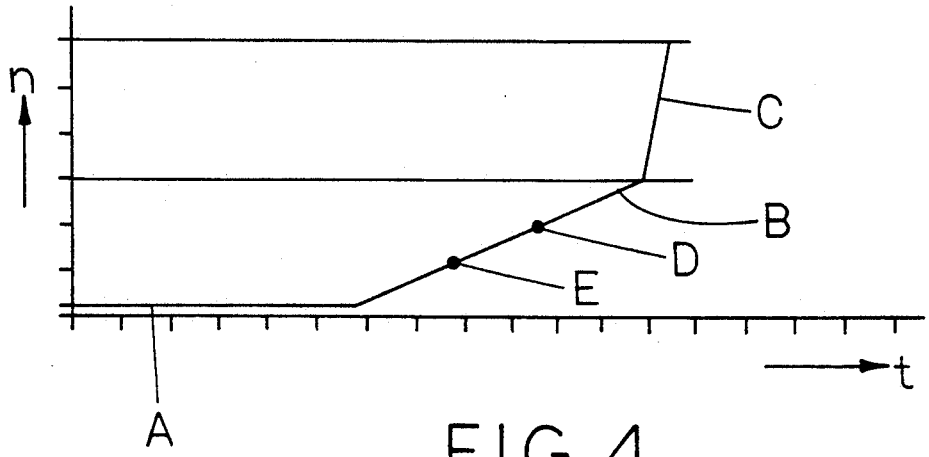
FIG. 4 depicts an acceleration and deceleration characteristic, in which the maximal change in the number of membrane-beats per unit of time is shown.

FIG. 4 shows a curve which depicts the number of beats per minute (n) of the piston 19 as a function of time (t). Starting from rest, rotation at a constant low beat-frequency is preferably maintained for some (i.e., region A of FIG. 4) a primary program curve is followed (in accordance with the time sequence curve of FIG. 2. This allows the regulating system to correct the amount of hydraulic medium in the pressure chamber which might have changed during standby of the pump. Subsequently the beat-frequency is increased. After overshoot of a primary value (D) of the beat-frequency, a transition occurs to the program run of FIG. 3. Only if the beat-frequency (n) falls below a secondary value (E), which is smaller than the primary value, will the program run of FIG. 2 be resumed. This hysteresis prevents undesired hopping back and forth between the program runs in the event of variations in the beat-frequency arising from cyclical fluctuations in torque in the mechanical load of the motor 20.

After the beat-frequency (n) has been increased by acceleration a certain velocity (region B of FIG. 4), it can, after a time and if so desired, be further increased to a certain value of the beat-frequency (region C of FIG. 4), in which case the extent of the increase is allowed to be greater than when the beat-frequency was smaller than the specific value referred to. Depending on the constitution and construction of the system, it is thus possible to indicate regions A, B and c in which, in regions B and C in particular, maximum permitted increases and decreases in the beat-frequency are prescribed. The system provides extensive freedom of choice of the various variables important to determination of the duration of the different periods c, d, e and f, whereby the system lends itself naturally to application in pumping sludges under a wide range of pressures and beat-frequencies. Above all, the system offers the possibility of conducting the calculations with any desired accuracy, thus allowing determination of the end positions of the membranes 12 and 13 within accurately determined tolerance-values about the end positions, and preventing unnecessary wear while pumping aggressive and abrasive media under extremely high pressures in the order of a few hundred bars (atmospheres of pressure) . The present universal and self-regulating control system can be applied to various types of single-membrane or multiple-membrane pumps.

What is claimed is:

1. System for controlling a piston membrane pump comprising at least one membrane, with the membrane being movable at a desired beat-frequency between two end positions, the member being positioned at a pressure chamber to be loaded and unloaded with hydraulic medium during suction and compression periods, means for detecting and indicating the position of the member, means for computing connected to the indicators to receive position-indication signals, and a hydraulic medium loading and unloading device connected to the computing means and pressure chamber for adding and removing hydraulic medium during the respective loading and unloading periods, the computing means using the position-indication signals for calculating the duration of a first delay period prior to the unloading period and a second delay period prior to the loading period, with said delay periods beginning around those times when the membrane is at its end positions, such calculations being based at least in part on the length of time of the separate unloading and loading periods immediately following said delay periods.

2. System according to claim 1, wherein that the computing means controls the loading and unloading device to load or unload the pressure chamber only if the indicators establish an overshoot of one of the end positions of the membrane.

3. System according to claim 2, wherein the computing means controls is responsive to the magnitude of the variation of the position-indication signals per unit time in establishing the time of approach at which the membrane assumes consecutive end positions, and is responsive to these times in determining as the starting-times of the respective delay periods.

4. System according to claim 3, wherein the computing means has an input connected to a sensor f or measuring the beat-frequency of the membrane.

5. System according to claim 4, wherein the system possesses a pressure sensor mounted in the pressure chamber, and the computing means possesses an input connected to the pressure sensor.

6. System according to claim 5, wherein the computing means selects lengths of the delay periods such that the respective loading and unloading periods are complete at times which lie within the suction period.

7. System according to claim 6, wherein the system is responsive to the beat-frequency as a basis for distinguishing between electable program runs in which the loading and unloading periods are distributed over the suction and compression periods.

8. System according to claim 7, wherein said distinction is made between a primary program run, in which the unloading period occurs before the transition from a compression stage to a suction state, and ends after that transition, and in which the loading period begins before the transition from the suction stage to the compression stage, and ends thereafter, and a secondary program run, in which lie the respective calculated delay periods before the distinct electable loading and unloading periods.

9. System according to claim 8, wherein if a preliminary value of the beat-frequency is exceeded, the computing means initiates the secondary program run at the expense of the primary program run, and, if the value of a secondary beat-frequency is reached, which value is smaller than the value of the primary program run at the expense of the secondary program run.

10. System according to claim 9, wherein the system memory having read and write means, whereby the variation of the values of pump operating parameters as measured by the indicators can be written and stored using the writing means, and whereby a desired selection of the value-variations, to be used in diagnosis and analysis of the process, can be called up out of memory using the reading means.

* * * * *